US006207361B1

(12) United States Patent
Greener et al.

(10) Patent No.: US 6,207,361 B1
(45) Date of Patent: Mar. 27, 2001

(54) PHOTOGRAPHIC FILM WITH BASE CONTAINING POLYMERIC ANTISTATIC MATERIAL

(75) Inventors: Jehuda Greener; Debasis Majumdar, both of Rochester; Thomas M. Laney, Hilton, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/472,486

(22) Filed: Dec. 27, 1999

(51) Int. Cl.[7] ..... G03C 1/89; G03C 1/795

(52) U.S. Cl. ..... 430/527; 430/529; 430/531; 430/536

(58) Field of Search ..... 430/527, 529, 430/531

(56) References Cited

U.S. PATENT DOCUMENTS

| | | | | |
|---|---|---|---|---|
| 3,245,833 | | 4/1966 | Trevoy . | |
| 3,428,451 | | 2/1969 | Trevoy . | |
| 4,078,935 | | 3/1978 | Nakagiri et al. . | |
| 4,203,769 | | 5/1980 | Guestaux | 430/631 |
| 4,275,103 | | 6/1981 | Tsubusaki et al. | 430/67 |
| 4,394,441 | | 7/1983 | Kawaguchi et al. | 430/527 |
| 4,416,963 | | 11/1983 | Takimoto et al. | 430/527 |
| 4,418,141 | | 11/1983 | Kawaguchi et al. . | |
| 4,431,764 | | 2/1984 | Yoshizumi . | |
| 4,495,276 | | 1/1985 | Takimoto et al. | 430/527 |
| 4,571,361 | | 2/1986 | Kawaguchi et al. . | |
| 4,845,369 | | 7/1989 | Arakawa et al. . | |
| 4,999,276 | | 3/1991 | Kawahara et al. | 430/527 |
| 5,006,451 | | 4/1991 | Anderson et al. | 430/527 |
| 5,110,639 | | 5/1992 | Akao | 428/35.2 |
| 5,116,666 | | 5/1992 | Konno | 430/220 |
| 5,122,445 | | 6/1992 | Ishigaki | 430/527 |
| 5,159,053 | * | 10/1992 | Kolycheck et al. | 528/76 |
| 5,368,995 | | 11/1994 | Christian et al. | 430/530 |
| 5,508,135 | | 4/1996 | Lelental et al. | 430/527 |
| 5,652,326 | * | 7/1997 | Ueda et al. | 528/288 |
| 5,863,466 | * | 1/1999 | Moi | 252/500 |

OTHER PUBLICATIONS

Abstract JP 05–253203, Oct. 5, 1993.
Derwent WPI Acc. No. 96–204406; (Abstract JP 8072213, Mar. 19, 1996).
D. Djordjevic, "Coextrusion", Rapra Review Reports, 1992, vol. 6, No. 2, pp. 3–15.
W. J. Schrenk & T. Alfrey, Jr., "Coextruded Multilayer Polymer Films and Sheets", Chap. 15, 1978, p. 129–165.

* cited by examiner

*Primary Examiner*—Richard L. Schilling
(74) *Attorney, Agent, or Firm*—Paul A. Leipold

(57) ABSTRACT

The invention relates to a photographic film imaging material comprising at least one silver halide layer and a base material comprising at least one extruded layer comprising a polymeric anti-static material.

14 Claims, No Drawings

PHOTOGRAPHIC FILM WITH BASE CONTAINING POLYMERIC ANTISTATIC MATERIAL

FIELD OF THE INVENTION

This invention relates in general to imaging elements, such as photographic, electrostatographic and thermal imaging elements and, in particular, to imaging elements comprising a support, an image-forming layer, and an electrically-conductive layer. More specifically, this invention relates to electrically-conductive layers comprising electrically-conductive polymers which can be applied during film extrusion and are integral to the photographic film support and to the use of such electrically-conductive layers in imaging elements for such purposes as providing protection against the generation of static electrical charges.

BACKGROUND OF THE INVENTION

Problems associated with the formation and discharge of electrostatic charge during the manufacture and utilization of photographic film and paper have been recognized for many years by the photographic industry. The accumulation of charge on film or paper surfaces leads to the attraction of dust, which can produce physical defects. The discharge of accumulated charge during or after the application of the sensitized emulsion layer(s) can produce irregular fog patterns or "static marks" in the emulsion. The severity of static problems has been exacerbated greatly by increases in the sensitivity of new emulsions, increases in coating machine speeds, and increases in post-coating drying efficiency. The charge generated during the coating process results primarily from the tendency of webs of high dielectric polymeric film base to charge during winding and unwinding operations (unwinding static), during transport through the coating machines (transport static), and during post-coating operations such as slitting and spooling. Static charge can also be generated during the use of the finished photographic film product. In an automatic camera, the winding of roll film out of and back into the film cassette, especially in a low relative humidity environment, can result in static charging. Similarly, high-speed automated film processing can result in static charge generation. Sheet films are especially subject to static charging during removal from light-tight packaging (e.g., x-ray films).

It is generally known that electrostatic charge can be dissipated effectively by incorporating one or more electrically-conductive "antistatic" layers into the film structure. Antistatic layers can be applied to one or to both sides of the film base as subbing layers either beneath or on the side opposite to the light-sensitive silver halide emulsion layers. An antistatic layer can alternatively be applied as an outer-coated layer either over the emulsion layers or on the side of the film base opposite to the emulsion layers or both. For some applications, the antistatic agent can be incorporated into the emulsion layers. Alternatively, the antistatic agent can be directly incorporated into the film base itself.

A wide variety of electrically conductive materials can be incorporated into antistatic layers to produce a wide range of conductivities. Most of the traditional antistatic systems for photographic applications employ ionic conductors. Charge is transferred in ionic conductors by the bulk diffusion of charged species through an electrolyte. Antistatic layers containing simple inorganic salts, alkali metal salts of surfactants, ionic conductive polymers, polymeric electrolytes containing alkali metal salts, and colloidal metal oxide sols (stabilized by metal salts) have been described previously. The conductivities of these ionic conductors are typically strongly dependent on the temperature and relative humidity in their environment. At low humidities and temperatures, the diffusional mobilities of the ions are greatly reduced and conductivity is substantially decreased. At high humidities, antistatic back-coatings often absorb water, swell, and soften. In roll film, this results in adhesion of the back-coating to the emulsion side of the film. Also, many of the inorganic salts, polymeric electrolytes, and low molecular weight surfactants used are water-soluble and are leached out of the antistatic layers during processing, resulting in a loss of antistatic function.

Antistatic systems employing electronic conductors have also been described. Because the conductivity depends predominantly on electronic mobilities rather than ionic mobilities, the observed electronic conductivity is independent of relative humidity and only slightly influenced by the ambient temperature. Antistatic layers have been described which contain conjugated polymers, conductive carbon particles, or semi-conductive inorganic particles.

Trevoy (U.S. Pat. No. 3,245,833) has taught the preparation of conductive coatings containing semi-conductive silver or copper iodide dispersed as particles less than 0.1 $\mu$m in size in an insulating film-forming binder, exhibiting a surface resistance of $10^2$ to $10^{11}$ ohms per square. The conductivity of these coatings is substantially independent of relative humidity. Also, the coatings are relatively clear and sufficiently transparent to permit their use as antistatic coatings for photographic film. However, if a coating containing copper or silver iodides was used as a subbing layer on the same side of the film base as the emulsion, Trevoy found (U.S. Pat. No. 3,428,451) that it was necessary to overcoat the conductive layer with a dielectric, water-impermeable barrier layer to prevent migration of semi-conductive salt into the silver halide emulsion layer during processing. Without the barrier layer, the semi-conductive salt could interact deleteriously with the silver halide layer to form fog and a loss of emulsion sensitivity. Also, without a barrier layer, the semi-conductive salts are solubilized by processing solutions, resulting in a loss of antistatic function.

Another semi-conductive material has been disclosed by Nakagiri and Inayama (U.S. Pat. No. 4,078,935) as being useful in antistatic layers for photographic applications. Transparent, binderless, electrically semi-conductive metal oxide thin films were formed by oxidation of thin metal films, which had been vapor deposited onto film base. Suitable transition metals include titanium, zirconium, vanadium, and niobium. The microstructure of the thin metal oxide films is revealed to be non-uniform and discontinuous, with an "island" structure almost "particulate" in nature. The surface resistivity of such semi-conductive metal oxide thin films is independent of relative humidity and reported to range from $10^5$ to $10^9$ ohms per square. However, the metal oxide thin films are unsuitable for photographic applications since the overall process used to prepare these thin films is complicated and costly, abrasion resistance of these thin films is low, and adhesion of these thin films to the base is poor.

A highly effective antistatic layer, incorporating an "amorphous" semi-conductive metal oxide, has been disclosed by Guestaux (U.S. Pat. No. 4,203,769). The antistatic layer is prepared by coating an aqueous solution containing a colloidal gel of vanadium pentoxide onto a film base. The colloidal vanadium pentoxide gel typically consists of entangled, high aspect ratio, flat ribbons 50–100 Å wide, about 10 Å thick, and 1,000–10,000 Å long. These ribbons stack flat in the direction perpendicular to the surface when the gel is coated onto the film base. This results in electrical conductivities for thin films of vanadium pentoxide gels (about 1 $\Omega^{-1}cm^{-1}$), which are typically about three orders of magnitude greater than is observed for similar thickness films containing crystalline vanadium pentoxide particles. In addition, low surface resistivities can be obtained with very low vanadium pentoxide coverages. This results in low optical absorption and scattering losses. Also, the thin films are highly adherent to appropriately prepared film bases. However, vanadium pentoxide is soluble at high pH and must be overcoated with a non-permeable, hydrophobic barrier layer in order to survive processing. When used with a conductive subbing layer, the barrier layer must be coated with a hydrophilic layer to promote adhesion to emulsion layers above. (See Anderson et al, U.S. Pat. No. 5,006,451)

Conductive fine particles of crystalline metal oxides dispersed with a polymeric binder have been used to prepare optically transparent, humidity insensitive, antistatic layers for various imaging applications. Many different metal oxides—such as ZnO, $TiO_2$, $ZrO_2$, $SnO_2$, $Al_2O_3$, $In_2O_3$, $SiO_2$, MgO, BaO, $MoO_3$ and $V_2O_5$—are alleged to be useful as antistatic agents in photographic elements or as conductive agents in electrostatographic elements in such patents as U.S. Pat. Nos. 4,275,103; 4,394,441; 4,416,963; 4,418,141; 4,431,764; 4,495,276; 4,571,361; 4,999,276; and 5,122,445. However, many of these oxides do not provide acceptable performance characteristics in these demanding environments. Preferred metal oxides are antimony doped tin oxide, aluminum doped zinc oxide, and niobium doped titanium oxide. Surface resistivities are reported to range from $10^6$–$10^9$ ohms per square for antistatic layers containing the preferred metal oxides. In order to obtain high electrical conductivity, a relatively large amount (0.05–10 g/$m^2$) of metal oxide must be included in the antistatic layer. This results in decreased optical transparency for thick antistatic coatings. The high values of refractive index (>2.0) of the preferred metal oxides necessitates that the metal oxides be dispersed in the form of ultrafine (<0.1 $\mu$m) particles in order to minimize light scattering (haze) by the antistatic layer.

Antistatic layers comprising electro-conductive ceramic particles, such as particles of TiN, $NbB_2$, TiC, $LaB_6$ or MoB, dispersed in a binder such as a water-soluble polymer or solvent-soluble resin are described in Japanese Kokai No. 4/55492, published Feb. 24, 1992.

Fibrous conductive powders comprising antimony-doped tin oxide coated onto non-conductive potassium titanate whiskers have been used to prepare conductive layers for photographic and electrographic applications. Such materials are disclosed, for example, in U.S. Pat. Nos. 4,845,369 and 5,116,666. Layers containing these conductive whiskers dispersed in a binder reportedly provide improved conductivity at lower volumetric concentrations than other conductive fine particles as a result of their higher aspect ratio. However, the benefits obtained as a result of the reduced volume percentage requirements are offset by the fact that these materials are relatively large in size such as 10 to 20 $\mu$m in length, and such large size results in increased light scattering and hazy coatings.

Use of a high volume percentage of conductive fine particles in an electro-conductive coating to achieve effective antistatic performance results in reduced transparency due to scattering losses and in the formation of brittle layers that are subject to cracking and exhibit poor adherence to the support material. It is thus apparent that it is extremely difficult to obtain non-brittle, adherent, highly transparent, colorless electro-conductive coatings with humidity-independent process-surviving antistatic performance.

The requirements for antistatic layers in silver halide photographic films are especially demanding because of the stringent optical requirements. Other types of imaging elements such as photographic papers and thermal imaging elements also frequently require the use of an antistatic layer but, generally speaking, these imaging elements have less stringent requirements.

A specific example of electrically-conductive layers which are especially advantageous for use in imaging elements and are capable of effectively meeting the stringent optical requirements of silver halide photographic elements are layers comprising a dispersion in a film-forming binder of fine particles of an electronically-conductive metal antimonate as described in Christian et al U.S. Pat. No. 5,368,995 issued Nov. 29, 1994. For use in imaging elements, the average particle size of the electronically conductive metal antimonate is preferably less than about one $\mu$m and more preferably less than about 0.5 $\mu$m. For use in imaging elements where a high degree of transparency is important, it is preferred to use colloidal particles of an electronically-conductive metal antimonate, which typically have an average particle size in the range of 0.01 to 0.05 $\mu$m. The preferred metal antimonates have rutile or rutile-related crystallographic structures and are represented by either Formula (I) or Formula (II) below:

$$M^{+2}Sb^{+5}{}_2O_6 \text{ wherein } M^{+2}=Zn^{+2}, Ni^{+2}, Mg^{+2}, Fe^{+2}, Cu^{+2}, Mn^{+2}, Co^{+2} \quad (I)$$

$$M^{+3}Sb^{+5}O_4 \text{ where } M^{+3}=In^{30\ 3}, Al^{+3}, Sc^{+3}, Cr^{+3}, Fe^{+3}, Ga^{+3} \quad (II)$$

Electrically conductive layers are also commonly used in imaging elements for purposes other than providing static protection. Thus, for example, in electrostatographic imaging it is well known to utilize imaging elements comprising a support, an electrically conductive layer that serves as an electrode, and a photoconductive layer that serves as the image-forming layer. Electrically-conductive agents utilized as antistatic agents in photographic silver halide imaging elements are often also useful in the electrode layer of electrostatographic imaging elements.

As indicated above, the prior art on electrically-conductive layers in imaging elements is extensive, and a very wide variety of different materials have been proposed for use as the electrically-conductive agent. There is still, however, a critical need in the art for improved electrically conductive layers which are useful in a wide variety of imaging elements, which can be manufactured at reasonable cost, which are resistant to the effects of humidity change, which are durable and abrasion-resistant, which are effective at low coverage, which are adaptable to use with transparent imaging elements, which do not exhibit adverse sensitometric or photographic effects, and which are substantially insoluble in solutions with which the imaging element typically comes in contact, for example, the aqueous alkaline developing solutions used to process silver halide photographic films.

Many imaging elements of the type hereinabove described include one or more layers which contain gelatin. Thus, the electrically conductive layer is commonly in adhering contact with a layer containing gelatin. Examples of photographic elements of such structure include elements in which the electrically-conductive layer is a subbing layer underlying a gelatin silver halide emulsion layer or a gelatin-containing anticurl layer, elements in which the electrically-conductive layer is an overcoat layer overlying a gelatin silver halide emulsion layer, and elements in which the electrically-conductive layer is an outermost layer overlying a gelatin-containing anticurl layer on the side of the support opposite to the silver halide emulsion layer.

It is extremely difficult to get adequate adhesion between an electrically conductive layer, which comprises a high concentration of electrically conductive metal-containing particles and a gelatin-containing layer, which is in adhering contact therewith. A major factor contributing to the adhesion problem is that the volumetric ratio of electrically-conductive metal-containing particles to binder in the electrically-conductive layer must usually be quite high in order to get the high level of electrical conductivity that is desired. For example, the electrically conductive metal-containing particles typically constitute 20 to 80 or more volume percent of the electrically conductive layer. As a result of too small an amount of binder being present in the electrically conductive layer, there can be a serious problem of inadequate adhesion to gelatin-containing layers that are in adhering contact therewith. This problem is solved by Lelental et al U.S. Pat. No. 5,508,135 by addition of a particular polyelectrolyte to the electrically conductive layer.

It is toward the objective of providing an improved electrically conductive layer, which is highly conductive and highly transparent and which is an integral part of the photographic support, that the present invention is directed.

PROBLEM TO BE SOLVED BY THE INVENTION

There is a need for antistatic transparent layers that are an integral part of the photographic support and do not require an additional coating step for applying said antistatic layers during or after support manufacturing.

SUMMARY OF THE INVENTION

It is an object of the invention to provide antistatic protection to an imaging element comprising at least one silver halide layer. These and other objects of the invention are accomplished by photographic film imaging element comprising at least one silver halide layer and a base material comprising at least one extruded layer comprising a polymeric antistatic material.

ADVANTAGEOUS EFFECT OF THE INVENTION

The invention provides a photographic support with an integral antistatic, transparent layer that obviates the need to apply an antistatic layer by a separate coating step during or after base manufacturing.

DETAILED DESCRIPTION OF THE INVENTION

The invention has numerous advantages over prior practices in the art. The invention provides photographic materials that have good antistatic properties and do not require a separate step for coating of antistatic layer. Further, the imaging members of the invention are much less likely to diminish their antistatic performance during processing and handling of the imaging layers. The imaging members of the invention having integral antistatic layers do not require a separate step for coating said antistatic materials, which would require removal of solvents and thereby increase manufacturing cost. As the imaging material of the invention is not after-coated with the antistatic material, there is no need for a drying step as required in prior art processes. There is a cost advantage, as there is one less coating and drying step required in image member formation. These and other advantages will be apparent from the detailed description below.

The invention preferably applies an antistatic layer through the co-extrusion method, thus eliminating the need to coat the support in a separate step and rendering the manufacturing process less costly. The antistatic layer thus applied is transparent and is able to survive photographic processing. Said polymeric layer is formed integrally with the support layer by the co-extrusion method during the support manufacturing step.

Of particular utility to this invention are polymers that are melt-processable under conditions similar to those used for producing polyester film base while, at the same time, are semi-conductive and able to provide antistatic protection to the photographic element. Such polymers are co-extruded through a specialized die together with the base polymer and are then stretched biaxially and heat-set as necessary, as is commonly done in the manufacture of a polyester film base for various imaging elements. The semi-conductive polymers also need to adhere strongly to the polyester base layer and remain strongly bonded after photographic processing.

There are several materials known in the art that can be melt-processed while retaining their antistatic activity and overall physical performance. These materials are various polymeric substances containing a high concentration of polyether blocks. Ionic conduction along the polyether chains makes these polymers inherently dissipative, yielding surface resistivities in the range $10^8$–$10^{13}$ ohm/square. Examples of such ionic conductors are: Polyether-block-copolyamide (e.g., as disclosed in U.S. Pat. Nos. 4,115,475; 4,195,015; 4,331,786; 4,839,441; 4,864,014; 4,230,838; 4,332,920; and 5,840,807), Polyetheresteramide (e.g., as disclosed in U.S. Pat. Nos. 5,604,284; 5,652,326; 5,886,098), and a thermoplastic polyurethane containing a polyalkylene glycol moiety (e.g., as disclosed in U.S. Pat. Nos. 5,159,053 and 5,863,466). Such inherently dissipative polymers (IDPs) have been shown to be fairly thermally stable and readily processable in the melt state in their neat form or in blends with other thermoplastic materials. Most of the known inherently conductive polymers (ICPs), such as polyaniline, polypyrrole and polythiophene, are not usually sufficiently thermally stable to be used in this invention. However, if the ICPs are thermally stabilized and are able to retain their electro-conductive properties after melt processing at elevated temperatures, they could also be applied in this invention.

In this invention we propose the use of various IDPs containing polyalkylene glycol chains as antistatic layers in photographic films comprising a polyester base. Because of their excellent melt processability these layers can be formed directly during the extrusion step of the film forming process through the co-extrusion method, thus eliminating the need to coat and dry a solvent-based antistatic layer as has been the practice heretofore. By contrast, co-extrusion of inorganic conductive filler dispersed in a polymeric matrix to form an extrudable conductive layer is impractical since the melt viscosity of such a dispersion is likely to be considerably higher than that of the base polyester resin at the high volume fractions (typically >50%) needed to achieve high conductivity. Generally, co-extrusion of adjacent layers with highly variant melt viscosities is not feasible particularly at high production throughputs.

Formation of polymeric films with an integral bilayer or a multilayer structure is usually accomplished by the co-extrusion method. By 'integral' we mean that the layers are formed at the same time and are firmly, permanently bonded to each other. Any one of the known techniques for co-extruding cast polymer sheets can be employed. Such forming methods are well known in the art. Typical co-extrusion technology is taught in W. J. Schrenk and T. Alfrey, Jr., "Coextruded Multilayer Polymer Films and Sheets," Chapter 15, Polymer Blends, p. 129–165, 1978, Academic Press; and D. Djorjevic, "Coextrusion," Vol. 6, No. 2, 1992, Rapra Review Reports. It is important that the cast, multilayered or bilayered sheet be subsequently oriented by stretching, at least in one direction. Methods of uniaxially or biaxially orienting sheet or film material are well known in the art. Basically, such methods comprise stretching the sheet or film at least in the machine or longitudinal direction, after it is cast on a chill roll, by an amount of about 1.5–4.5 times its original dimension. Such sheet or film may also be stretched in the transverse or cross-machine direction by apparatus and methods well known in the art, in amounts of generally 1.5–4.5 times the original dimension. Stretching to these ratios is necessary to sufficiently orient the polymer layers and achieve desired levels of thickness uniformity and mechanical performance. Such apparatus and methods are well known in the art and are described, for example, in U.S. Pat. No. 3,903,234. The stretched film is commonly subjected to a heat-setting step after the transverse direction stretch to improve dimensional stability and mechanical performance.

A preferred embodiment of the invention comprises polyethylene terephthalate (PET) or its copolymers as the base layer and a particular IDP in its neat form or in a blend with PET or another polyester as the electrically conductive, antistatic layer. The antistatic layer is placed preferably on the side of the base layer opposite the silver halide emulsion layer and its thickness can vary in the range 0.1–10 $\mu$m. The concentration of the IDP in the antistatic layer must exceed some critical concentration to insure that the conductivity of the layer is maintained at a desired level. The IDP/polyester blend in the electrically conductive layer may contain a small amount of a compatibilizer, that is, a dispersing aid used to improve the uniformity and quality of the dispersion of the electrically conductive polymer in the matrix. Generally, blending the IDP with PET or other polyesters should help in lowering cost, improve adhesion of the conductive layer to the base PET layer, and improve the processability and mechanical properties of the antistatic layer.

The following examples illustrate the practice of this invention. They are not intended to be exhaustive of all possible variations of the invention. Parts and percentages are by weight unless otherwise indicated.

EXAMPLES

The IDP formulations used in the examples herein below include the following commercially available materials:

| IDP Sample | Supplier | Conducting Polymer |
|---|---|---|
| Pebax 1074 | Elf Atochem | Polyether-block-copolyamide |
| Pebax 1657 | Elf Atochem | Polyether-block-copolyamide |
| Stat-Rite M690 | B. F. Goodrich | Segmented polyether-urethane |
| Stat-Rite E1140 | B. F. Goodrich | Segmented polyether-urethane |
| Pelestat NC6321 | Sanyo Chemical | Polyetheresteramide |

In the examples of this invention we use PET and PETG (a fully amorphous polyester resin) as base layers and PETG is also used for the purpose of alloying with the IDPs in the antistatic layer. The PET has an inherent viscosity of 0.70 dl/g and the PETG resin has an inherent viscosity of 0.75 dl/g.

In preparation of the samples, all resins were dried at 65° C. for 24 hr and fed by two plasticating screw extruders into a co-extrusion die manifold to produce a two-layered melt stream, which is rapidly quenched on a chill roll after issuing from the die. By regulating the throughputs of the extruders, it is possible to adjust the thickness ratio of the antistatic and base layers in the cast sheet. In the examples herein below, these cast sheets are referred to as "extruded", wherein the thickness ratio of the conducting antistatic layer to that of the base layer is maintained at approx. 1:10. In some instances the cast sheet is stretched in the machine direction at a ratio of 3.3 at a temperature of 110° C., and then in the transverse direction at a ratio of 3.3 and a temperature of 110° C. In the examples herein below, these latter samples are referred to as "stretched" wherein the final film thickness is adjusted to approx. 100 $\mu$m, but the thickness ratio of the antistatic and base layers is maintained at approx. 1:10. The layers within the co-extruded film are fully integrated and strongly bonded.

For resistivity tests, samples are preconditioned at 50% RH (unless otherwise noted) and at 72° F. for at least 24 hours prior to testing. Surface electrical resistivity (SER) is measured with a Keithly Model 616 digital electrometer using a two point DC probe by a method similar to that described in U.S. Pat. No. 2,801,191. For desirable performance, the antistatic layer should exhibit SER values <13 log ohms/square.

Film samples 1–11, listed in Table 1, were prepared in accordance with the present invention. The structures and compositions of the various film samples are specified in Table 1, and the corresponding SER values are given in Table 2. It is shown that all the samples, prepared in accordance with the current invention, have SER values significantly less than 13 log ohms/square at 50% RH and, hence, are desirable for antistatic protection of photographic film elements. It is also clear that the SER values of said samples are not significantly dependent on relative humidity. The SER variation within the range 5–50% RH is found to be <±1 log ohms/square. This demonstrates the utility of the present invention in imparting surface electrical conductivity to a photographic film based on a polyester support and, hence, providing antistatic protection to said films over a wide range of relative humidity. It is also noted that all the films listed in Table 1, produced to illustrate this invention, are clear and transparent.

TABLE 1

| Sample # | IDP | Comp. of Antistatic Layer (wt %) | Base Layer | Type |
|---|---|---|---|---|
| 1 | Pebax 1074 | Pebax 1074 | PET | Extruded |
| 2 | Pebax 1074 | Pebax 1074 | PET | Stretched |
| 3 | Pebax 1074 | Pebax 1074/ PETG 50/50 | PET | Extruded |
| 4 | Pebax 1074 | Pebax 1074/ PETG 50/50 | PET | Stretched |
| 5 | Pebax 1657 | Pebax 1657/ PETG 50/50 | PET | Extruded |
| 6 | Pebax 1657 | Pebax 1657/ PETG 50/50 | PET | Stretched |
| 7 | SR M690 | SR M690 | PET | Extruded |
| 8 | SR M690 | SR M690 | PET | Stretched |
| 9 | SR E1140 | SR E1140 | PETG | Stretched |
| 10 | NC 6321 | NC 6321/PETG 50/50 | PET | Stretched |
| 11 | NC 6321 | NC 6321 | PET | Stretched |

TABLE 2

| Sample # | SER @ 50% RH (log ohms/square) | SER @ 20% RH (log ohms/square) | SER @ 5% RH (log ohms/square) |
|---|---|---|---|
| 1 | 10.2 | | 10.4 |
| 2 | 11.3 | 11.3 | |
| 3 | 10.7 | | 11.2 |
| 4 | 11.9 | 11.6 | |
| 5 | 9.8 | | |
| 6 | 11.1 | 11.5 | |
| 7 | 11.0 | | |
| 8 | 11.5 | | |
| 9 | 10.9 | | |
| 10 | 12.0 | | |
| 11 | 10.1 | | |

The invention has been described in detail with particular reference to certain preferred embodiments thereof, but it will be understood that variations and modifications can be effected within the spirit and scope of the invention.

What is claimed is:

1. A photographic film imaging element comprising at least one silver halide layer applied onto a film support, wherein said support comprises at least one extruded layer comprising a polymeric antistatic material that is integral with at least one other layer of said support.

2. The imaging element of claim 1 wherein said at least one extruded layer further comprises a polymeric matrix material for said polymeric antistatic material.

3. The imaging element of claim 1 wherein said polymeric antistatic material comprises at least one material selected from the group consisting of polyetheresteramide, polyether block copolyamide, and segmented polyether urethane.

4. The imaging element of claim 1 wherein said polymeric antistatic layer is on the side of the base layer opposite the side of the silver halide emulsion.

5. The imaging element of claim 1 wherein said film support comprises a polymer base layer having an antistatic material integrally formed onto the bottom side.

6. The imaging element of claim 1 wherein said film support comprises a polymer base layer selected from the group consisting of polyesters, polycarbonates, polystyrenes, acrylics, and polyamides.

7. The imaging element of claim 1 wherein said imaging material has a surface electrical resistivity on the bottom of said film support that is less than 13 log ohm/square.

8. The imaging element of claim 2 further comprising a compatibilizer to aid in dispersion of said polymeric antistatic material in said matrix polymer.

9. The imaging element of claim 8 wherein said compatibilizer comprises polymers that are independently miscible with the matrix polymer and the antistatic polymer.

10. The imaging element of claim 2 wherein said matrix polymer comprises a polyester.

11. The imaging element of claim 2 wherein said matrix polymer comprises at least one member selected from the group consisting of polycarbonates, polyurethanes, acrylics, polyamides, and polystyrenes.

12. The imaging element of claim 1 wherein said base material comprises an oriented polymer film.

13. The imaging element of claim 1 wherein said antistatic layer is translucent or transparent.

14. The imaging element of claim 1 wherein said antistatic layer is polyaniline or other inherently conductive polymer that is processable in the melt state without losing its electro-conductive properties.

* * * * *